United States Patent [19]

Tokunaga et al.

[11] Patent Number: 4,974,030

[45] Date of Patent: Nov. 27, 1990

[54] CLEANING DEVICE FOR ELECTROSTATIC RECORDING APPARATUS

[75] Inventors: Hiroshi Tokunaga; Takaaki Yamanaka; Yoshio Yamazaki, all of Hachioji, Japan

[73] Assignee: Konica Corporation, Tokyo, Japan

[21] Appl. No.: 506,571

[22] Filed: Apr. 6, 1990

Related U.S. Application Data

[63] Continuation of Ser. No. 121,676, Nov. 17, 1987, abandoned.

[30] Foreign Application Priority Data

Nov. 18, 1986 [JP] Japan ..... 61-276220

[51] Int. Cl.[5] ..... G03G 21/00

[52] U.S. Cl. ..... 355/296; 355/297

[58] Field of Search ..... 355/296, 297, 298, 299; 118/652; 430/125; 15/256.52

[56] References Cited

U.S. PATENT DOCUMENTS 3,947,108 3/1976 Thetta et al. ..... 355/297
4,181,425 1/1980 Higaya et al. ..... 355/296
4,364,329 12/1982 Murai et al. ..... 118/652
4,618,250 10/1986 Noguchi et al. ..... 355/15

FOREIGN PATENT DOCUMENTS 57-176083 10/1982 Japan ..... 355/15
59-111673 6/1984 Japan ..... 355/15
60-221784 11/1985 Japan ..... 355/15

OTHER PUBLICATIONS

*Xerox Disclosure Journal,* vol. 2, No. 4, 1977, Kane, Thomas J., "Apparatus for Reducing Photoreceptor Filming".

*Primary Examiner*—Joan H. Pendegrass
*Attorney, Agent, or Firm*—Jordan B. Bierman

[57] ABSTRACT

The invention provides an electrostatic image forming apparatus in which electrostatic latent image formed on a photoreceptor is developed with toner, the toner image is transferred onto a recording paper, thereafter the residual toner image is removed from the photoreceptor by the cleaning device. The cleaning device according to the invention has a cleaning roller which contains abrasive grain and come in contact with the photoreceptor in order to remove foreign substance such as fine paper particles in addition to the residual toner.

15 Claims, 5 Drawing Sheets

FIG. 1-a
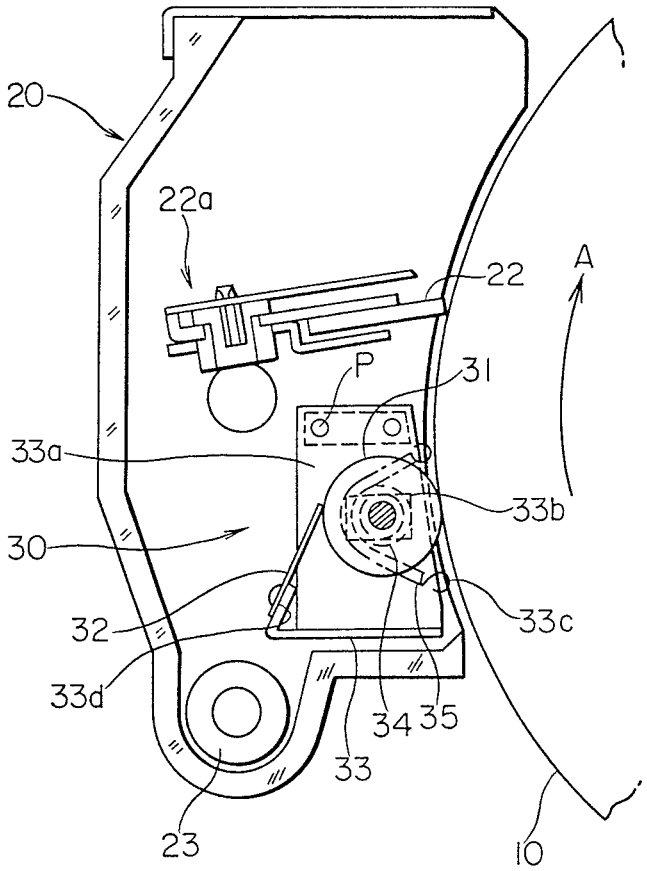

FIG. 1-b
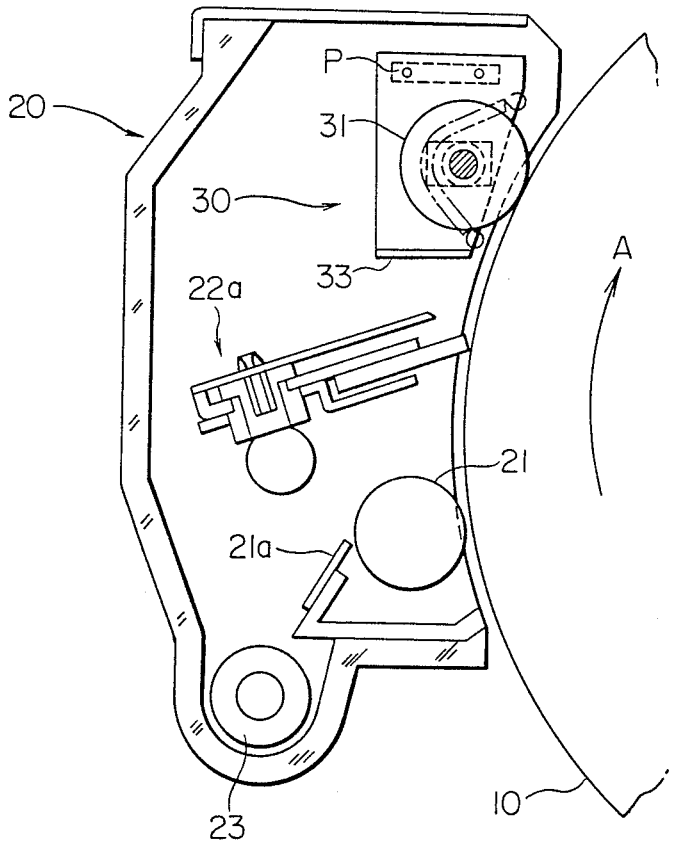

CLEANING DEVICE FOR ELECTROSTATIC RECORDING APPARATUS

This application is a continuation of application Ser. No. 121,676, filed Nov. 17, 1987 now abandoned.

FIELD OF THE INVENTION

The present invention relates to an image forming apparatus using an electrostatic photographic process, in particular to an electrostatic recording apparatus having an improved cleaning device.

There is an image forming apparatus available, wherein an electrostatic latent image formed on the surface of a traveling image carrying member is converted into a developed toner image by the development process, and the developed image is transferred onto a transfer material principally made of paper, then the residual toner present on the surface of image carrying member, as well as foreign matters which include fine paper particles derived from a transfer paper and adhered onto the surface of image carrying member, and rosin, talc and the like which also derived from a transfer paper, and corona product produced by a high-voltage generating member, are removed in order to enable the repeated use of the image carrying member. Such an apparatus is essentially required to have a cleaning device which removes the above mentioned toner and foreign matters, in order to ensure a high quality hard copy.

Organic photoconductive photosensitive materials have been increasingly used for image carrying members, partly because such materials may be applied and set on an electrically conductive material without using a vapor deposition method. However, an image carrying member comprising an organic photoconductive photosensitive material readily causes imaging failure under a high humidity, often greatly deteriorating the quality of copied image. Accordingly, such an image carrying member more frequently requires the cleaning procedure.

Various cleaning devices have been proposed; they include means using a fur brush, cleaning plate, web and the like. Though being capable of removing the residual toner, these conventional cleaning devices unsatisfactorily remove talc and rosin released from a transfer paper, as well as corona charge product. Once these substances adhere onto the surface of image carrying member, especially under a high humidity, the electric insulation around these substance will decrease as they absorb moisture. This phenomenon greatly disturbs an electrostatic latent image, possibly resulting in the extremely deteriorated quality of copied image, namely in the imaging failure. The conventionally available countermeasures to prevent the imaging failure in copied image, which deteriorates image quality, are as follows.

1. To reduce the amount of corona products including ozone generated by corona charge, by an ozone absorbing means.

2. To reduce a force, with which a cleaning blade is pressed onto an image carrying member, for alleviating the deposition of substances adhering to the similar member.

3. To use highly abrasive particles as an additive to developer in order to promote the abrasive function when toner particles rub an image carrying member in a developing process, or when a cleaning blade is pressed upon the surface of similar member.

4. To form a toner image also on a non-image area of an image carrying member, when performing cleaning with a blade, in order to promote the scraping operation with a cleaning blade.

5. To raise a temperature on an image carrying member by incorporating a heater which reduces the water absorption by the similar member.

These methods have specific disadvantages. When singly used, these methods fail to constitute a perfect counter-measure, and, may cause a new problem.

More specifically, the above method 1 requires a special, ozone absorbing means. The method 2 often causes the cleaning failure where the residual toner is not thoroughly removed. The method 3 is disadvantageous in terms of durability of developer, because the toner and carrier readily wear off. The method 4 incurs a wasteful consumption of developer. The method 5 incurs a complicated configuration and the associated high cost due to the provision of a heater. There is another problem; the continuously energized heater also heats members other than the image carrying member.

Japanese Patent Open to Public Inspection (hereinafter referred to as Japanese Patent 0.P.I. Publication) No. 107675/1985 and Japanese Patent 0.P.I. Publication No. 67073/1986 disclosed a configuration with a resilient roller (of rubber) which is rubbed against an image carrying member in order to remove talc, rosin, or corona charge products. However, simply incorporating the resilient roller does not satisfactorily provide a force to scrape against the image carrying member, and fails to remove talc, rosin, or corona charge products.

Additionally, using a sponge roller as a resilient roller often leads to unsatisfactory results, as the removed substances such as residual toner or the like falls off from an area of contact between the roller and an image carrying member, or as the removed substances adhere onto the surface of image carrying member once the substances clog pores of sponge.

The above disclosure, still further incurs disadvantages; the apparatus is expensive and its structure is complicated, because the outer circumferential surface comprises a multi-layer resilient material, and the roller is linked to a driving mechanism so that the roller is driven at a specific speed relative to that of an image carrying member.

SUMMARY OF THE INVENTION

With an improvement incorporated to solved these disadvantages, the object of the invention is to provide an electrostatic recording apparatus having a simply-structured cleaning device which is capable of efficiently removing the residual toner, and previously mentioned talc, rosin or corona charge product, by means of a single-layered roller which is manufactured with a smaller cost.

Additionally, the object of the invention is to provide a cleaning device which constitutes a satisfactory counter-measure against the imaging failure without combined employing other means, and provides satisfactory scraping function to remove talc, rosin, or corona charge products, and which does not cause wear or scratch on the image carrying member.

The above object is attained by an image forming apparatus in which a developed image is formed on a traveling image carrying member and the surface of image carrying member is cleaned after the image transfer, in order to allow the surface to be repeatedly used, more specifically, by an electrostatic recording apparatus having a roller which, in contact and rotating in synchronization with the image carrying member, is disposed in the upstream or downstream side of the cleaning device and contains abrasive grains or agent.

BRIEF DESCRIPTION OF THE DRAWINGS

FIG. 1-*a* and 1-*b* illustrate the constitution of a cleaning device which an image recording apparatus of the invention has.

DETAILED DESCRIPTION OF THE INVENTION

Figure 2:
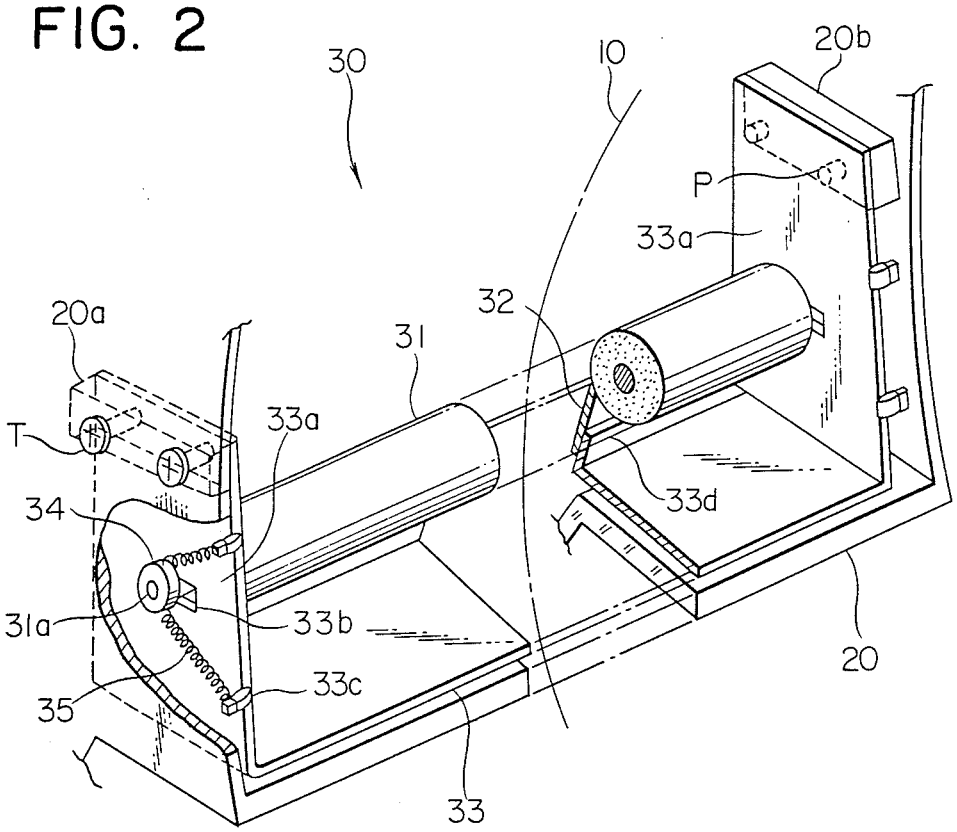
FIG. 2 is a perspective view of the principal area of the same apparatus.

FIG. 1-*a* and 2 jointly illustrate one example embodying the invention.

FIG. 1-*a* illustrates a cleaning device which, the electrostatic recording apparatus of the invention has, wherein inside a cleaning case 20, whose opening faces the circumferential surface of a photosensitive drum 10 which serves as an image carrying member, are disposed, at the downstream side in rotation direction (indicated by an arrow A), a cleaning blade 22, as well as, the upstream side of these cleaning means, another cleaning means, that is, a roller 31 of the invention also serving as a toner guide roller, and a scraper 32 which is in contact with the roller 31.

The cleaning blade 22 is a major cleaning member made of hard urethane plate, and onto which clockwise pressing force is exerted from a blade holder 22*a* securing it. Accordingly, the tip of blade 22 presses against the circumferential surface of the photosensitive drum 10.

The example photosensitive member according to the invention is composed of a conductive drum, provided thereon, an organic photoconductive photosensitive layer. The photosensitive member is hereinunder described.

The organic photoconductive photosensitive layer usually comprises an organic photoconductive material which is distributed in a binder resin, and has a thickness of, for example, 10 to 30 μm. The organic photoconductive photosensitive layer may be a single layer, or, otherwise a function-separated type two layer constitution which comprises a layer to generate carrier and a layer to transport the carrier. When the similar photosensitive layer has a two-layer constitution, the thickness of carrier generating layer is for example 0.05 to 5 μm; the thickness of carrier transporting layer is for example 10 to 30 μm. The carrier generating layer usually contains a thermoplastic binder resin at the rate of 20 to 90 weight%, favorably 30 to 70 weight%; the carrier transporting layer contains the similar resin at the rate of 30 to 80 weight%, or favorably, 50 to 70 weight%.

The carrier generating layer is formed by dissolving or dispersing, together with an appropriate binder resin, a known carrier generating substance into a solvent, and applying the solution onto a base. The examples of known various carrier generating substances include azo dyes such as monoazo dye, bisazo dye and trisazo dye; perylene dyes such as perylene anhydride and perylene imide; indigo dyes such as indigo and thioindigo; polycyclic quinones such as anthraquinone, pyrenequinone and flavathrone; quinacridone dyes; bisbenzimidazole dyes; indanthrone dyes; squalelenium dyes; phthalocyanine dyes such as metal phthalocyanine and non-metal phthalocyanine; euteric complexes of such as pyrylium salt dye and polycarbonate; thiapyrylium salt dye and polycarbonate; and others. Among these examples, the advantageous coating solution is prepared by dispersing a carrier generating substance of phthalocyanine, bisazo or quinone compound into a binder made of high molecular material such as polycarbonate.

The carrier transporting layer is formed by dissolving or dispersing, together with an appropriate binder resin, a carrier transporting substance into a solvent, and applying the solution onto a base. The examples of carrier transporting substances include compounds having in the principal chain or side chain a polycyclic aromatic compound such as anthracene, pyrene, phenanthrene, coconene or the like; compounds, which has a nitrogen-containing aromatic ring, for example indole, carbazole, oxazole, isooxazole, thiazole, triazole, indazole, pyrazole, oxadiazole, pyrazoline or the like; compounds having a triphenylamine skeleton, stylbene skeleton or hydrazone skeleton. Among these examples, the advantageous coating solution is prepared by dispersing a carrier transporting substance of styrylamine, hydrazone, carbazole or hydrazine.

As binder resins used in the carrier generating layer and carrier transporting layer, various resins are available based on the combination with a carrier generating substance or carrier transporting substance. Commonly used resins are polyester, polyethylene, polyamide, polycarbonate, epoxy, poly-N-vinylcarbazole, polystyrene, polyvinyl butyral, polymethyl methacrylate and the like.

The previously mentioned roller 31 which is in contact with the above organic photoconductive photosensitive layer is a soft, resilient roller made of urethane rubber, chloroprene rubber or the like, which contains fine abrasive grains or abrasive agent. It is preferable that the hardness of the rubber is 20 to 50 (HS) and the thickness of the rubber is 2 to 5 mm. It is favorable that the roller 31 is made of foamed sponge. The suitable abrasive grains are made of aluminum oxide (alundum), silicon, carbide (carborundum), cerium oxide or the like, and have a grain size of 0.5 to 50 microns.

An experiment confirmed that a preferred foamed material used as the above roller 31 has a foam size of 0.2 to 1 mm, and that a conductive rubber material other than the previously mentioned urethane rubber or chloroprene rubber may be used, and that the roller 31 preferably contact with the photosensitive drum 10 with a distortion of 0.5 to 2 mm.

As shown in FIGS. 1 and 2, being attached to a frame member 33 of a roller support unit 30, and housed in the previously mentioned cleaning case 20, the roller 31 is pressed against the circumferential surface of photosensitive drum 10, thereby the roller 31 is driven counterclockwise as a follower of the drum 10.

More specifically, the frame member 33 has a pair of side members 33*a* in the positions symmetrical with each other in the lateral direction, whereby bearings 34 with which the left and right axles 31*a* of the previously mentioned toner guide roller 31 are correspondingly supported are inserted into the slot 33b which is formed respectively on the left and right side members. This arrangement enables the rotation of roller 31, and, at the same time, movably supports the roller 31 along the circumferential surface of the photosensitive drum 10.

On each of the above bearings 34, the portion protruding from the side member 33a constitutes a flange where the circumferential face is shaped a groove of a semi-circular cross section, thereby a tension spring 35, of which both ends secured onto projections 33c which are located on the front rim of the above side member 33a, is engaged into the groove and exerts a pressing force onto the above toner guide roller along the above slot 33b. It should be noted that the pressing force exerted onto both ends of toner guide roller 31 by the bearing 34 and the tension spring 35 is adjusted to be identical and equilibrated in both left and right ends.

The frame member 33 has a bent 33d on its rear rim, to allow the installation of the scraper 32, wherein the angle of bent is deliberately determined, so that, if the frame member 33 is attached to the cleaning case 20 in accordance with a method described later, the tip of the scraper 32 comprising a resilient plate such as a Myler plate can press with a prescribed load not disturb the rotation of the roller 31, the circumferential surface of the roller 31 which is in a displaced position being pushed back by the photosensitive drum 10 against the exerted force from the tension spring 35.

The roller support unit 30 having the above described constitution is attached to the cleaning case 20 in the following manner.

Both the left and right walls of the cleaning case 20 have mounts 20a and 20b respectively on their internal face. A pair of circular holes disposed on one of the side member 33a of the frame member 33 are correspondingly engaged with a pair of pins P embedded in the mount 20b, thereby the frame member 33 is easily locked in the working position with a pair of retaining screws T which are inserted to fix the mount 20a from outside the cleaning case 20. Accordingly, the vertical position of each of the bases 20a and 20b from the floor of frame 33 is deliberately determined in order to allow a room for installing or housing the roller support unit.

Thus, only attaching the roller support unit 30 completes the attaching and adjusting procedure for the roller 31 and scraper 32. Resultingly, being forced back by the circumferential surface of the photosensitive drum 10 against the tension of the tension spring 35, the roller 31 is pressed onto the photosensitive drum with a specific load (preferable load is 5–100 g/cm), whereby the conditions under which the scraper 32 is pressed onto the roller are satisfied.

Consequently, the roller 31, which is pressed onto the circumferential surface of the photosensitive drum 10 and driven as a follower, removes residual toner present on the photosensitive drum 10, which is rotating in the arrow A direction, by means of rubbing function derived from its own deflection, and, simultaneously, the abrasive effect by the abrasive grains or abrasive agent contained in the roller 31 scrapes and removes solid foreign substances such as talc, rosin or corona product which cannot be removed only by the rubbing function. This arrangement further improves the cleaning effect in the earlier stage of copying operation.

The roller 31 also serves as a toner guide roller, which receives and collects falling toner powder having been scraped by the cleaning blade in the downstream side of the roller 31.

More specifically, being rotating counterclockwise as a follower of the photoconductive drum 10, the roller 31 transports the toner powder collected on its circumferential surface to the scraper 32. The transported toner powder slides down on the scraper and is transferred outside the cleaning case 20 via a toner transporting screw 23, for repeated use.

The comparison example the inventor employed is hereinunder described.

With softness and resilience of sponge, the roller 31 presses the surface of photosensitive drum 10 and removes the residual toner as well as various foreign substances by the abrasive function of abrasive grains/agent it contains.

Then, firstly the comparative test was performed between the roller 31 according to the invention and the conventional roller having no abrasive grains.

The comparative test was carried out under following condition; rollers having a 4.5 mm thick sponge thereon (total outer diameter of 15.2 mm) were disposed at the upstreameside of a cleaning blade serving as a scraping means, the rollers were arranged to served as cleaning roller coming into pressure contact with photosensitive drum having 20 μm thick photosensitive layer made of organic photoconductive material in addition to serve as toner guiding roller with a scraper, wherein such roller acted as a driven roller through such pressure contact.

In above arrangement, roller containing no abrasive grains as conventional roller and rollers containing abrasive grains according to the invention were prepared and continuous actual copying operation performed to observe whether or not imaging failure took place.

Test results are listed in Table 1.

TABLE 1

| Grain size and weight percent of abrasive agent | Imaging failure |
|---|---|
| NIL | x |
| 3 (μm) 50 (parts) | o |
| 3 (μm) 30 (parts) | o |
| 2.5 (μm) 50 (parts) | o |

In the case where the conventional roller in incorporated, the imaging failure was observed after copying around 200–1000 sheets.

On the other hand, in the case where the roller containing the abrasive grains in the amount of 50 parts by weight whose grain size is 3 μm average diameter was incorporated, the imaging failure was not observe even after copying 50000 sheets.

Further, the continuous actual copy operations are performed respectively for the rollers containing abrasive grains (50 parts 2.5 μm and 30 parts 3 μm), the imaging failure was not observed even after copying 50000 sheets.

Incidentally, the softness and resilience of the sponge roller are dependent upon the density of foamed sponge roller, and expansion ratio (foaming density) is expressed by the specific gravity of a rubber material constituting the sponge roller. Accordingly, using various rollers made of rubber materials individually has a unique specific gravity, the inventors examined the movement of the roller as a follower of the photosensitive drum 10 as well as the abrasive operation.

Table 2 lists the results of the examination.

TABLE 2

| Specific gravity gr/cm$^2$ | Judgement |
|---|---|
| 0.1 | Δ |
| 0.2 | Δ |
| 0.3 | o |
| 0.4 | o |
| 0.5 | o |
| 0.6 | o |
| 0.7 | o |
| 0.8 | o |
| 0.9 | Δ |
| 1.0 | Δ |

It is apparent that rollers made of rubber materials having a specific gravity of smaller than 0.3 (a larger expansion ratio) readily wear and develops clogging (represented by Δ in Judgement column of the table). Additionally, it was learned that rubber materials having a specific gravity of larger that 0.8 (a smaller expansion ratio) requires a greater force (represented by Δ in Judgement column of the table) with which the roller is pressed onto the photosensitive drum 10.

In other words, as can be understood from the results in Table 2, a rubber material, which contains abrasive grains/ agent, having an expansion ratio comparable to a specific gravity of 0.3 to 0.8 is appropriate for the roller 31. For high performance, the specific gravity may be preferably limited within a range of 0.5 to 0.6.

Next, from the viewpoint that the size of abrasive grains contained in the roller 31 substantially affects not only the abrasive effect which the roller exerts on the photosensitive drum 10, but the service lives of the photosensitive drum 10 and the scraper 31, the inventor performed experiment by way of actual copying operation, involving as many as twenty thousand copying papers, using diverse types of sponge rollers respectively having abrasive agent of unique grain size. The results are listed in Table 3.

TABLE 3

| Grain size of abrasive agent (μm) | Imaging failure | Wear of photo-sensitive drum | Wear of scraper |
|---|---|---|---|
| 1 | Δ | small | small |
| 1.5 | Δ | small | small |
| 3 | o | small | small |
| 7 | o | small | small |
| 10 | o | small | moderate |
| 15 | o | moderate | moderate |
| 25 | o | large | large |

The conditions of experiment were as follows: a roller 31 with an external diameter of 15.2 mm, which obtained 50 parts of carborundum of a specific grain size listed in Table 3 and served also as a toner receiver, was disposed in the upstream side of a cleaning blade 22 serving as a cleaning means; the roller 31 comprising a 4.5 mm thick sponge was pressed onto a photosensitive drum 10 with an external diameter of 80 mm having a 20 μm thick photosensitive layer made of organic photoconductive material (OPC), thereby the roller 31 performed as the rotating follower of the drum 31.

A scraper 32 pressed onto the roller 31 was made of 0.1 mm thick stainless steel for a plate spring.

Next, the results of experiment listed in Table 3 are detailed below. In terms of removal effects on the residual toner and foreign substances present on the photosensitive member by the roller 31, the abrasive agent with a grain size of less than 1.5 μm indicated to lower such removal effects.

In terms of wear on the photosensitive layer of the photosensitive drum 10, when the above described roller 31 was employed, a roller containing an abrasive agent with a grain size of larger than 15 μm satisfactorily removed the residual toner and foreign substances present on the photosensitive member and achieved the conditions for high quality duplicate. However, such a roller at the same time indicated to wear out the photosensitive layer on the photosensitive drum 10. To sum up these results, the specific range of grain size of an abrasive agent which does not induce the imaging failure nor significantly wear out both the photosensitive drum 10 and the scraper 32 is as follows: the maximum grain size is smaller than 15 μm, and in this example, the size is smaller than 10μm as allowance in size being incorporated; the minimum grain size is 2 μm in order to constantly produce high quality duplicates.

Next, from the viewpoint that the rate of content of abrasive grains contained in the roller 31 substantially affects not only the abrasive effect which the sponge roller exerts on the photosensitive surface of photosensitive drum 10, but the service life of the photosensitive surface, the inventors performed experiment by way of actual copying operation, involving as many as fifty thousand copying papers, using diverse types of sponge rollers respectively having abrasive agent at a specific content rate. The results are listed in Table 4.

TABLE 4

| Weight percent of contained abrasive agents (parts) | Imaging failure |
|---|---|
| 20 | Δ |
| (1) 30 | o |
| (2) 50 | o |
| (3) 70 | o |

The conditions of experiment were as follows: a roller 31 with an external diameter of 15.2 mm, which contained carborundum with a grain size of 3 μm (GC#4000) at a specific percentage listed in Table 4 and served also as a toner receiver, was disposed in the upstream side of a cleaning blade 22 serving as a cleaning means; the roller 31 comprising sponge with hardness of 50 to 55 (ASKER C) was pressed onto a diameter 80 mm photosensitive drum 10 having a 20 μm thick photosensitive layer made of organic photoconductive material (OPC), thereby the roller 31 acted as the rotating follower of the drum 31. In this course, a guideline for the pressure with which the roller 31 was pressed onto the drum 10 was a nip width of 2 mm on the drum.

A scraper 32 pressed onto the roller 31 was made of 0.1 mm thick stainless steel for a plate spring.

Figure 3:
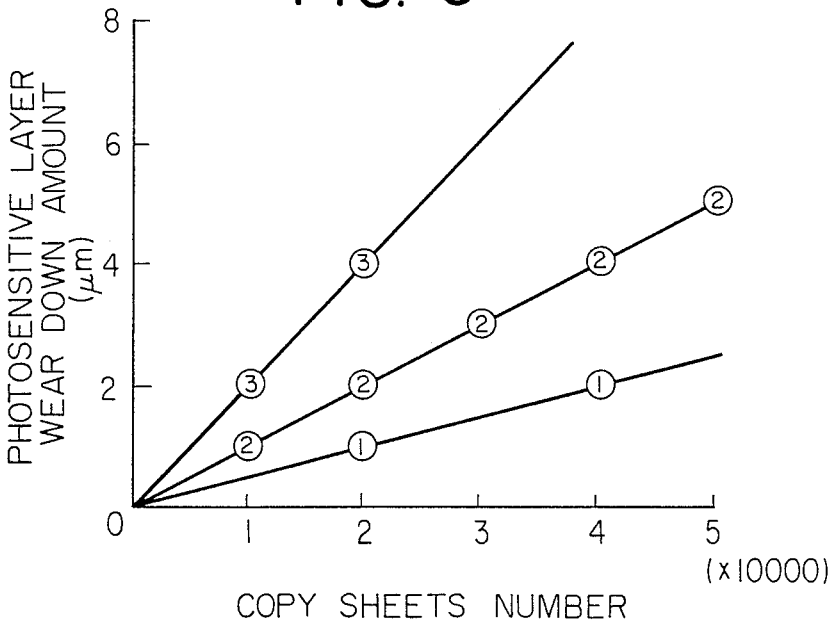
FIG. 3 graphically illustrates the service lives of photoconductive drum.

Next, the results of experiment indicated both in Table 4 and FIG. 3 are detailed below. In terms of removal effects on the residual toner and foreign substances present on the photosensitive layer by the roller 31, a sponge roller whose abrasive agent content was smaller than 20 parts by weight indicated to lower abrasive effects, and, accordingly, it was observed in such a roller that the imaging failure caused by toner and foreign substances still remaining on the photosensitive layer showed the tendency to take place. Therefore, it was confirmed that the preferred percentage of contained abrasive agent is any of the values (1), (2) and (3) in Table 4, that is, at least 30 parts.

In terms of wear on the photosensitive layer of the photosensitive drum 10 induced by the above described roller 31, the photosensitive layer wear down amount increased in proportion to the number of copy sheets, as indicated by FIG. 3. This tendency is significant especially with the percentage of contained abrasive agent expressed by value (3) in Table 4, that is, the case where a sponge roller having 70 parts abrasive agent. In view of a practical service life, this ratio may constitutes the upper limit; it may be difficult to employ a sponge roller containing more than 80 parts of abrasive agent in a practical operation, though having excellent cleaning effect.

To sum up these results, a weight percentage of abrasive agent which does not induce significant wear of the photosensitive layer on photosensitive drum 10 is preferred not to exceed 70 parts. At the same time, the lower limit may be more than 30 parts, in view of another criterion, the cleaning effect in order to perfectly prevent the imaging failure.

Next, the scraper is described below. With the above mentioned sponge roller made of foamed material, toner and foreign substances readily adheres to the similar roller and clog the pores of sponge. If these contaminants remained unremoved for an extended period, it is difficult to maintain the cleaning effect of the sponge roller. Correspondingly, a scraper is pressed onto the surface of roller in order to swiftly remove the adhered toner and foreign substances.

As a material for scraper, a thin Myler plate (PET film) can be selectively used in the invention, among resin materials. This material, however, may deform due to frictional heat, depending the size and amount of the abrasive grain contained the roller 31.

In the case of a metal material, which requires consideration with respect to corrosion, a nonferrous, resilient thin plate, usually, a plate spring made of phosphor bronze can be used in the invention. Such a material, with Vickers hardness of less than approximately 175, may be worn down depending on the abrasive grains/agent the sponge roller contains.

To solve such disadvantage and to realize a deformation-free scraper, associated with a sponge roller, whose corrosion is extremely limited and which is capable of exerting a stable pressing force upon the sponge roller for an extended service life, the inventors have introduced an arrangement, wherein the one end of the scraper 32 comprising a resilient plate made of a 0.1 to 0.15 mm thick stainless steel spring plate is secured with a retaining screw or the like to the previously mentioned bent 33*d*, and the other end is pressed onto the circumferential surface of the roller 31 with a prescribed force so that the end add the circumferential surface substantially form a line of contact.

As the material for the above stainless steel spring plate, the following types are suitable, and a specific type is selected in compliance with conditions of usage. However, in view of wear resistance, SUS 304-CSPH which is the hardest among these types is particularly favorable. The types of stainless steel spring plate available, as well as their hardness are as follows which are represented by J.I.S.:

(1) SUS 304-CSPH Vickers hardness, higher than 370

(2) SUS 304-CSP1/2H Vickers hardness, higher than 250

(3) SUS 631-CSP Vickers hardness, higher than 200

Figure 4:
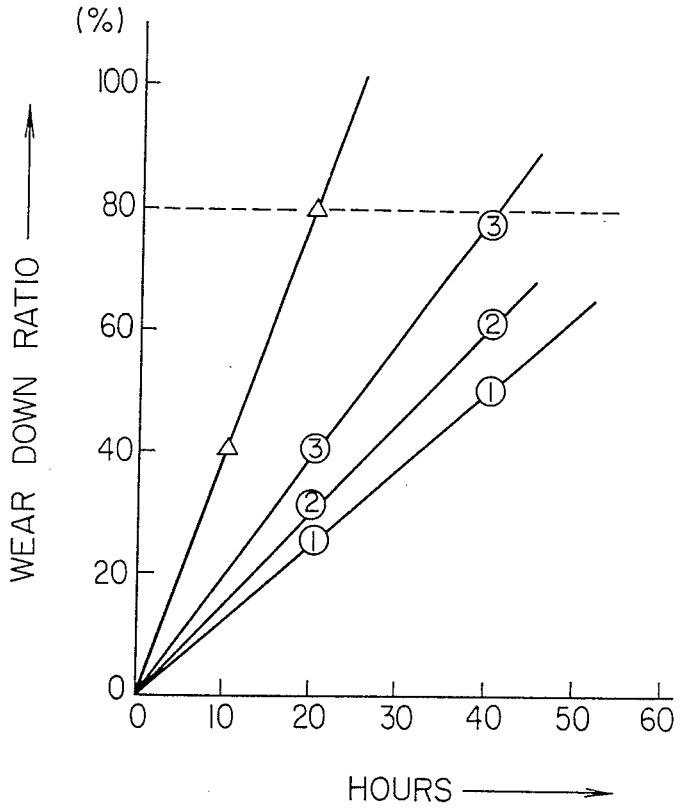
FIG. 4 graphically illustrates the wear resistance properties of a scraper.

FIG. 4 graphically compares the degrees of wear on the scrapers 32 respectively made of the above stainless steel spring plates. For this experiment, a sponge roller receiving the pressing force is a roller 31 with an external diameter of 15.2 mm involving 4.5 mm thick sponge and containing 50 parts of GC; the roller rotates as a follower of the photosensitive drum 10.

When compared to a resilient plate used as a scraper and made of phosphor bronze plate (C5210P-1/2H; Vickers hardness, lower than 170) and indicated by Δ in the graph of FIG. 4, the scrapers made of stainless steel spring plate are significantly superior. Apparently, the scraper made of SUS304-CSPH excels in wear resistance and endures longer. When the wear down ratio exceeds 80%, a scraper loses its function and must be replaced with a new one.

Figure 5A:
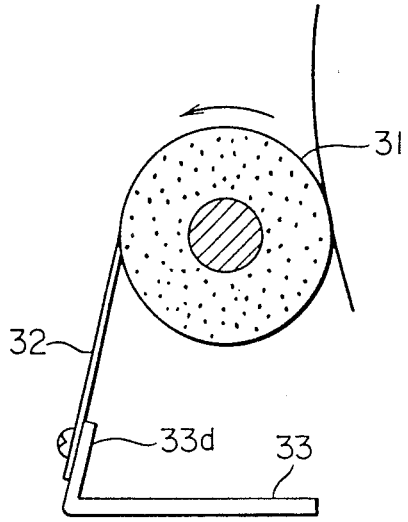
FIG. 5A and 5B illustrates two configurations of scraper.
Figure 5B:
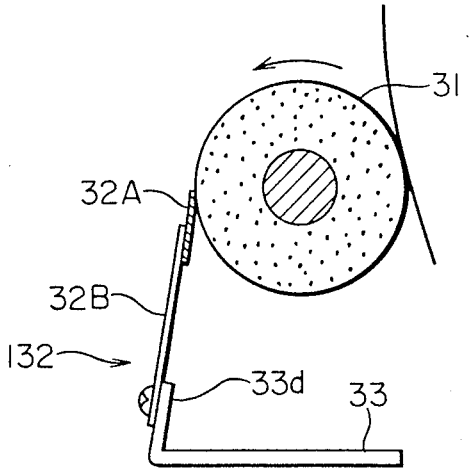

FIGS. 5(A) and 5(B) respectively illustrate a stainless steel spring plate in actual use. FIG. 5(A) illustrates the most common cleaning device, where the whole scraper comprises single stainless steel spring plate whose resilience allows its tip to be pressed onto a roller 31. In this example, the thickness of plate spring is selected from a range of 0.1 to 0.15 mm.

FIG. 5(B) illustrates a cleaning device, wherein only the tip 32A of scraper 132 which presses the roller 31 is made of the above mentioned stainless steel spring plate. This arrangement allows use of a different highly resilient material as a supporting portion 32B. This in turn realizes a high performance scraper which has not only wear resistance but high resilience.

In this example, the roller is rotated counterclockwise as a follower of the photosensitive drum 10. However, instead of using the roller 31 as a follower, it is possible to rotate the roller 31 counterclockwise by means of a driving mechanism, and, if necessary, to provide the roller 31 with a specific velocity relative to the photosensitive drum 10.

This example discloses an arrangement where the roller 31 serves as a toner guide roller. However, disposing the roller 31 in a downstream location beyond the cleaning blade 22 as shown in FIG. 1-*b* provides the same cleaning effect.

According to this configuration, since it is not necessary for the roller 31 to convey the toner scraped off by the cleaning blade, abovementioned scraper 32 and 132 are not required to be provided with the roller 31. Further, since the roller 31 is not stained so much than the case as shown in FIG. 1-*a*, cleaning action against the image carrying member will be more effective.

Still further, since the roller does not convey the toner scraped off by the cleaning blade as mentioned above, rotation direction of the roller 31 is not limited. Therefore, the roller is allowed to act as the follower driven by the image carrying member, or is allowed to be driven another driving mechanism in either one direction clockwise or counterclockwise.

In the case where the roller is driven by another driving mechanism, it is preferable that the speed ratio of the roller against the image carrying member is adjusted around 0.5–2.0.

On the other hand, in above embodiment where the roller is located at downstream side of the cleaning blade as shown in FIG. 1-*b*, it is necessary to provide additionally a toner guide roller at upperstream side of the cleaning blade, accordingly the cleaning case may become larger in size. However, in this emodiment as shown in FIG. 1-*b*, to incorporate the roller 31 into the cleaning case as one unit is not essentially required, it may be allowed to incorporate it into a separate box smaller than the cleaning box. Because such separate box is not required to collect the toner therein. In passing, in the former embodiment as shown in FIG. 1-*a*, to incorporate the roller 31 into the cleaning case may be more preferable, because, by doing so it is not necessary to prepare additionally a toner collecting vessel.

According to the invention, the residual toner as well as foreign substances generated in the course of image processing are readily removed from the image carrying member, thus allowing a clean photosensitive surface to be reused. This leads to the realization of an electrostatic recording apparatus which is free from imaging failure and capable of providing high quality duplicates for an extended period of actual operation. The effects of the invention are significant especially with an electrostatic recording apparatus having an image carrying member comprising an organic photoconductive photosensitive member.

Only pressingly a roller containing abrasive grains/abrasive agent onto an image carrying member and make it serve as a follower of the latter satisfactorily removes talc, rosin or corona products.

The roller according to the invention contains abrasive grains/abrasive agent, and, accordingly, eliminates the necessity of providing abrasive operation using toner deliberately adhered to the roller. In essence, the roller of the invention stably provides sufficient abrasive function without using toner as an abrasive agent.

What is claimed is:

1. An electrostatic recording apparatus wherein a toner image is formed on a rotatable image carrying member and is transferred from said image carrying member onto a recording medium, said image carrying member being rotatable in a direction and reused to receive a further toner image, said apparatus comprising a rotatable cleaning roller adapted to contact said image carrying member at contact point, said roller containing an abrasive agent, said roller adapted to rotate in said direction at said contact point and having a specific gravity of about 0.5 to about 0.6, and a scraper pressing onto a surface of said cleaning of said cleaning roller thereby scraping off substances tending to collect thereon.

2. The apparatus of claim 1 wherein said cleaning roller is sponge.

3. The apparatus of claim 1 wherein said abrasive agent comprises granules having diameters of 2 to 10 μm.

4. The apparatus of claim 1 wherein said roller contains 30 to 70% by weight of said abrasive agent.

5. The apparatus of claim 1 further comprising a cleaning blade to clean said image carrying member.

6. The apparatus of claim 5 wherein said cleaning roller is located upstream of said cleaning blade.

7. The apparatus of claim 5 wherein said cleaning roller is driven by said image carrying member.

8. The apparatus of claim 1 wherein said scraper is stainless steel.

9. The apparatus of claim 1 wherein said cleaning roller is sponge, said abrasive agent comprises granules having diameters of 2 to 10 μm, and said roller contains 30 to 70 parts by weight of said abrasive agent.

10. An electrostatic recording apparatus wherein a toner imkage is formed on a rotatable image carrying member and is transferred from said image carrying member onto a recording medium, said image carrying member being rotatable in a direction and reused to receive a further toner image, said apparatus comprising a rotatable cleaning roller adapted to contact said image carrying member at contact point, said roller containing an abrasive agent, said roller adapted to rotate in said direction at said contact point and having a specific gravity of about 0.5 to about 0.6, and a scraper pressing onto a surface of said cleaning of said cleaning roller thereby scraping off substances tending to collect thereon, said cleaning roller being a sponge, there being a cleaning blade to clean said image carrying member, said cleaning roller located upstream of said cleaning blade.

11. The apparatus of claim 10 wherein said abrasive agent comprises granules having diameters of 2 to 10 μm.

12. The apparatus of claim 10 wherein said roller contains 30 to 70% by weight of said abrasive agent.

13. The apparatus of claim 10 wherein said cleaning roller is driven by said image carrying member.

14. The apparatus of claim 10 wherein said scraper is stainless steel.

15. The apparatus of claim 10 wherein said cleaning roller is sponge, said abrasive agent comprises granules having diameters of 2 to 10 μm, and said rollers contains 30 to 70 parts by weight of said abrasive agent.

* * * * *